United States Patent [19]

Longshore et al.

[11] Patent Number: 4,667,172

[45] Date of Patent: May 19, 1987

[54] CERAMIC TRANSMITTER COMBINER WITH VARIABLE ELECTRICAL LENGTH TUNING STUB AND COUPLING LOOP INTERFACE

[75] Inventors: Theodore F. Longshore, Hoffman Estates; Ronald J. Wanat, Elgin, both of Ill.

[73] Assignee: Motorola, Inc., Schaumburg, Ill.

[21] Appl. No.: 849,099

[22] Filed: Apr. 7, 1986

[51] Int. Cl.[4] ..... H01P 5/12; H01P 1/201; H01P 7/08

[52] U.S. Cl. ..... 333/134; 333/202; 333/223; 333/224; 333/234; 333/263

[58] Field of Search ..... 333/128, 136, 224, 234, 333/235, 246, 263, 126, 134, 202, 223

[56] References Cited

U.S. PATENT DOCUMENTS

| | | | |
|---|---|---|---|
| 2,436,427 | 2/1948 | Ginzton | 333/263 X |
| 3,139,597 | 6/1964 | French et al. | 333/161 |
| 3,339,158 | 8/1967 | Passaro . | |
| 3,440,573 | 4/1969 | Butler | 333/161 |
| 3,621,476 | 11/1971 | Kanbayashi . | |
| 3,633,104 | 1/1972 | Gray . | |
| 3,673,518 | 6/1972 | Carr . | |
| 3,701,054 | 10/1972 | Hagler . | |
| 3,840,828 | 10/1974 | Linn et al. . | |
| 4,019,161 | 4/1977 | Kimura et al. . | |
| 4,024,481 | 5/1977 | Kivi . | |
| 4,136,320 | 1/1979 | Nishikawa et al. . | |
| 4,211,986 | 7/1980 | Tajima . | |
| 4,241,322 | 12/1980 | Johnson et al. . | |
| 4,375,622 | 3/1983 | Hollingsworth . | |
| 4,488,130 | 12/1984 | Young et al. . | |
| 4,488,132 | 12/1984 | Collins et al. . | |
| 4,525,690 | 6/1985 | De Ronde . | |
| 4,543,545 | 9/1985 | Craine et al. | 333/128 |

FOREIGN PATENT DOCUMENTS 0141803 11/1980 Japan .

OTHER PUBLICATIONS

"Design of Cylindrical Dielectric Resonators in Inhomogeneous Media" by Rene R. Bonetti and Ali E. Atia, IEEE Transactions on Microwave Theory and Techniques, vol. MTT-29, No. 4, 4-1981.

"Microwave Bandpass Filters Containing High-Q Dielectric Resonators" by Seymour B. Cohn, IEEE Transactions on Microwave Theory and Techniques, vol. MTT-16, No. 4, Apr. 1968.

*Primary Examiner*—Paul Gensler

*Attorney, Agent, or Firm*—Rolland R. Hackbart

[57] ABSTRACT

Transmitter combining apparatus includes up to five RF filters (100) coupled to a microstrip combiner (300) for combining up to five input signals for application to a common antenna. The RF filter (100) includes a ceramic resonator (116) sandwiched between first and second compensating discs (114 and 120) and first and second shield plates (142 and 148) for temperature compensation, low loss mounting and heat sinking of the ceramic resonator (116). Good thermal contact between the ceramic resonator (116), discs (114 and 120) and shield plates (142 and 148) is produced by a compressive force exerted by springs (144–147) of shield plate (142) when the top cover (112) is attached to the aluminum housing (124). The resonant frequency of the RF filter is tuned by means of an aluminum tuning shaft (102) and ceramic tuning core (118) which are positioned by brass bushing (133) in top cover (112). Input signals are coupled to each RF filter via respective input coupling loops (122) and output signals are coupled via corresponding output coupling loops (311) to the microstrip combiner (300). The microstrip combiner (300) includes a circuit board (310) having five transmission lines (601–605) and a short-circuited tuning transmission line (610), all coupled to a junction (620). The microstrip combiner (300) is tuned by means a variable impedance produced by varying the position of a dielectric tuning plate (630) with respect to a the tuning transmission line (610).

20 Claims, 9 Drawing Figures

CERAMIC TRANSMITTER COMBINER WITH VARIABLE ELECTRICAL LENGTH TUNING STUB AND COUPLING LOOP INTERFACE

BACKGROUND OF THE INVENTION

The present invention is generally related to radio frequency (RF) combiners coupling a plurality of RF transmitters to a single antenna and more particularly to a variable electrical length tuning stub and coupling loop interface for a ceramic transmitter combiner.

In order to combine a number of RF transmitters, the RF signals from each transmitter must be isolated from one another to prevent intermodulation and possible damage to the transmitters. RF filters of the air-filled cavity type may be utilized to provide isolation between the RF transmitters. Each such cavity filter is tuned to pass only the RF signal from the transmitter to which it is connected, each RF transmitter producing a different frequency RF signal. The outputs from each filter may be combined and coupled to a common antenna by combining apparatus of the type shown and described in U.S. Pat. No. 4,375,622. Each filter is coupled to this combiner by precisely equal lengths of coaxial cable. The combiner is tuned by means of manually adjustable transmission lines or stubs, which likewise are coupled to the combiner by a coaxial cable. However, such combiners are not only difficult to tune, but also expensive and require an inordinate amount of precious space.

SUMMARY OF THE INVENTION

Accordingly, it an object of the present invention to provide improved combiner tuning circuitry that produces an input impedance that may be varied over a range centered about a predetermined input impedance.

It is another object of the present invention to provide a compact and inexpensive RF signal combiner that includes unique variable reactance tuning circuitry.

It is yet a further object of the present invention to provide improved RF signal combining apparatus utilizing a unique coupling interface between a microstrip combiner and two or more ceramic filters.

Briefly described, the present invention encompasses RF signal combining apparatus including a unique coupling interface between a microstrip combiner and two or more ceramic filters. The microstrip combiner further includes unique tuning circuitry and a substrate circuit board having a plurality of microstrip transmission lines and coupling circuit boards each coupling a corresponding ceramic filter to a junction. The unique tuning circuitry includes a substrate circuit board having a first side and a second side, the second side having metallic plating thereon; a tuning transmission line having an input coupled to the junction of the microstrip combiner, having a predetermined length, disposed on the first side of the substrate circuit board and being terminated by a predetermined terminating impedance; a dielectric plate having a predetermined dielectric constant for covering the tuning transmission line, the input impedance of the tuning circuitry having a predetermined imput impedance when the dielectric plate covers one-half of the tuning transmission line; and apparatus for adjusting the amount by which the dielectric plate covers the tuning transmission line to vary the input impedance of said tuning circuitry over a range centered about the predetermined input impedance.

DESCRIPTION OF THE PREFERRED EMBODIMENT

Figure 1:
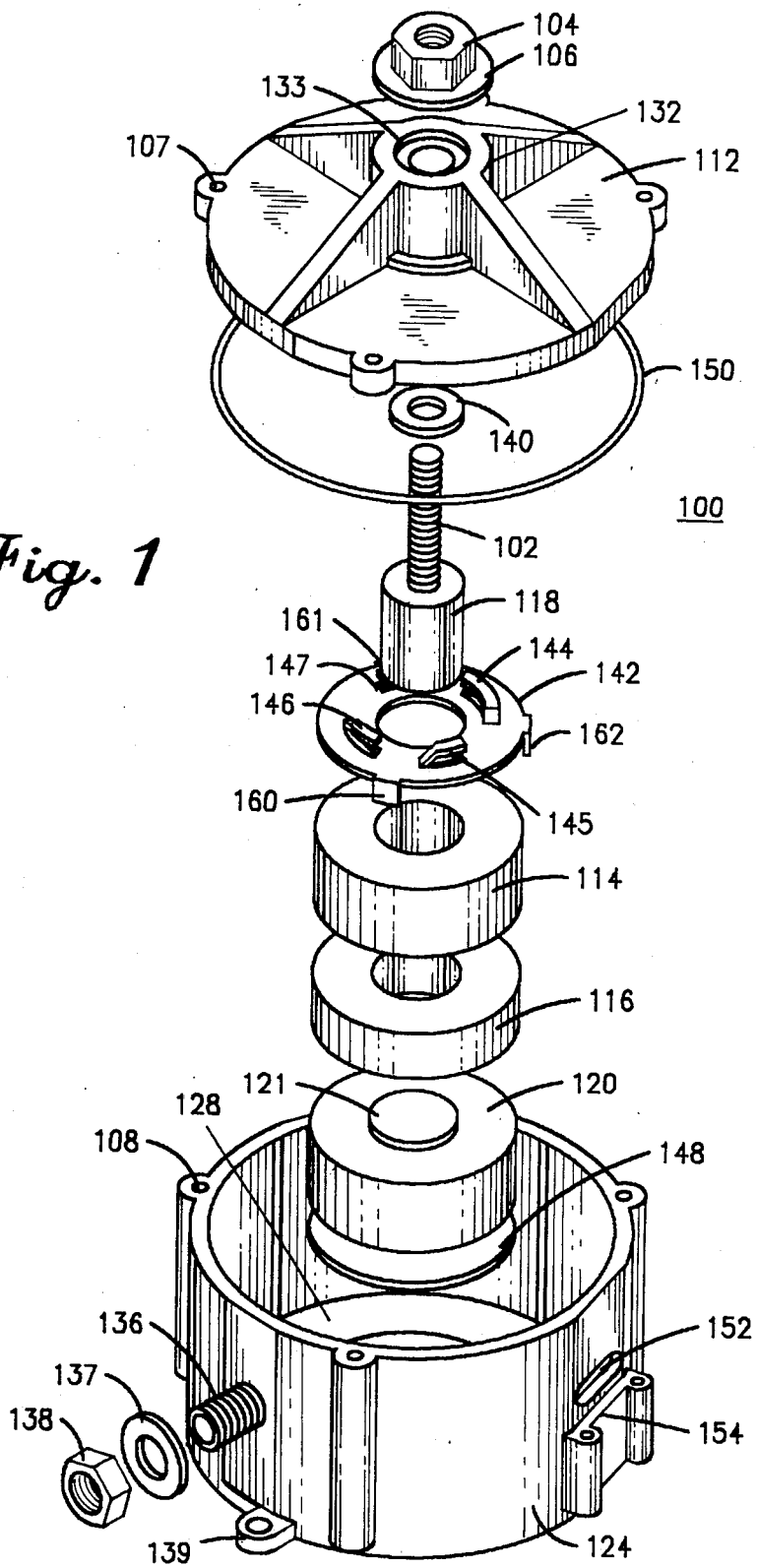
FIG. 1 is an exploded perspective view of the preferred embodiment of the RF filter of the present invention.
Figure 2:
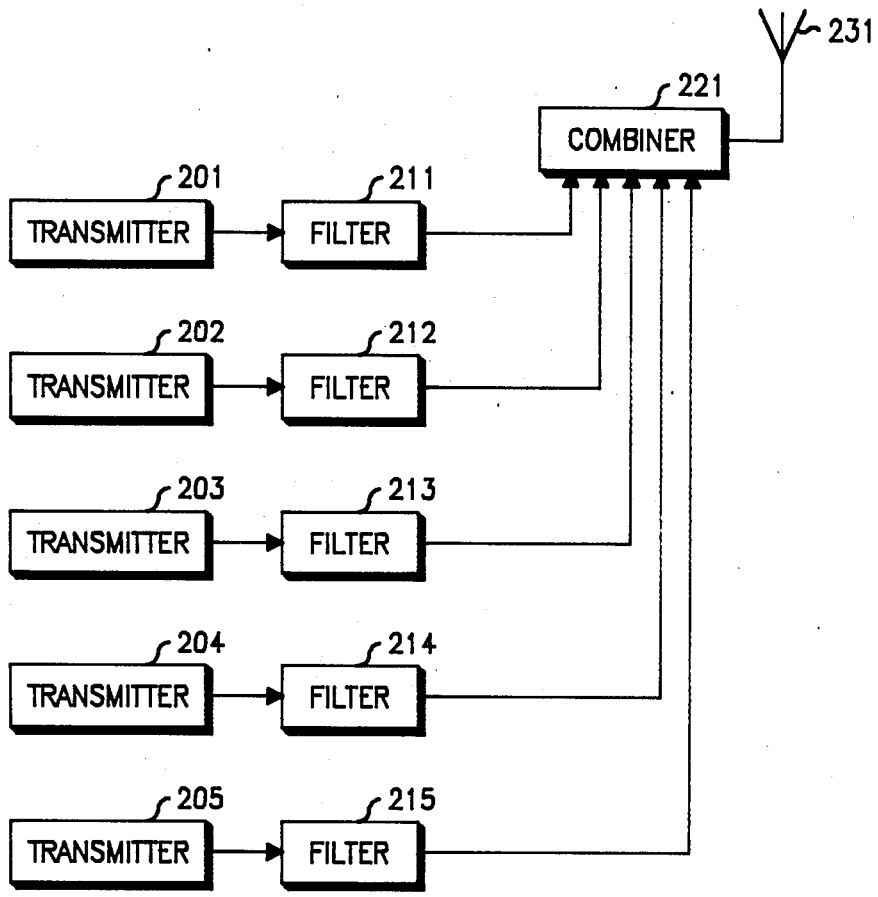
FIG. 2 is a block diagram of combining apparatus advantageously utilizing RF filters illustrated in FIG. 1 for coupling RF signals from respective RF transmitters to a combiner for application to a common antenna.

In FIG. 1, there is illustrated an exploded view of an RF filter 100 that is particularly well adapted for use in the antenna combining apparatus in FIG. 2 for combining two or more RF transmitters operating in the frequency range from 870–896 mHz. The nominal unloaded Q of filter 100 is approximately 14,000. The frequency shift of filter 100 over the ambient temperature range of −30° C. to +60° C. is a maximum of 55 kHz with respect to the nominal frequency at room temperature. The nominal dimensions of filter 100 are 5.5″ in diameter and 3″ in length, as compared to 6″ in diameter and 13″ in length for a conventional air-filled cavity filter. In addition to being much smaller than an equivalent air-filled cavity filter, filter 100 results in a materials cost saving of 60% over the equivalent air-filled cavity filter.

Referring to FIG. 1, filter 100 includes a ceramic resonator 116 which is sandwiched between a first compensating disc 114 and second compensating disc 120. Resonator 116 is preferably comprised of a ceramic compound having a dielectric constant of at least thirty-six. Commercially available ceramic compounds such as those including pre-selected amounts of barium oxide, titanium oxide, zirconium oxide, zinc oxide, lanthanum oxide and/or tin oxide may be used. For example, suitable ceramic compounds are described in U.S. Pat. No. 3,938,064 and in an article by G. H. Jonker and W. Kwestroo, entitled "The Ternary Systems BaO—$TiO_2$—$SnO_2$ and BaO—$TiO_2$—$ZrO_2$", published in the Journal of American Ceramic Society, Volume 41, Number 10, October 1958, at pages 390–394 (incorporated herein by reference thereto). Of the ceramic compounds described in the Jonker article, the compound $Ba_2Ti_9O_{20}$ in Table VI having the composition 18.5 mole percent BaO, 77.0 mole percent $TiO_2$ and 4.5 mole percent $ZrO_2$ and having a dielectric constant of forty may be used for resonator 116. Many of the other ceramic compounds in the Jonker article may likewise be utilized. Compensating discs 114 and 120 are preferably comprised of alumina ($Al_2O_3$) since alumina exhibits low dielectric loss, high thermal conductivity relative to ceramic resonator 116 and a positive dielectric temperature coefficient with respect to that of ceramic resonator 116.

According to an important feature of filter 100, the negative dielectric temperature coefficient of ceramic resonator 116 can be substantially compensated by the positive dielectric temperature coefficient of alumina compensating discs 114 and 120. That is, the −36 ppm/°C. dielectric temperature coefficient of the ceramic resonator 116 can be substantially offset by the +113 ppm/°C. dielectric temperature coefficient of the alumina compensating discs 114 and 120. As is known in the art, the dielectric temperature coefficient of a dielectric material is proportional to the physical size. Therefore, the desired compensation is achieved by selecting the thickness of the alumina compensating discs 114 and 120 so that their dielectric temperature coefficient is substantially the same in magnitude but opposite in sign to the dielectric temperature coefficient of resonator 116.

Moreover, the alumina compensating discs 114 and 120 not only provide for ambient temperature compensation, but also minimize temperature rise due to RF power dissipation of ceramic resonator 116 by providing a low thermal resistance between ceramic resonator 116 and the top and bottom covers 112 and 128 of the filter housing, and minimize the overall RF loss of the filter by supporting the resonator 116 away from the loss-inducing aluminum covers 112 and 128. Since alumina conducts heat much better than air, alumina discs 114 and 120 efficiently conduct heat from resonator 116 to covers 112 and 128 and housing 124, thereby minimizing the temperature rise in resonator 116. A compressive force exerted by springs 144–147 of shield plate 142 maintains good thermal contact between the resonator 116 and covers 112 and 128, such that the thermal resistance between resonator 116 and covers 112 and 128 is less than 1° C./W (i.e. 0.68° C./W predicted by design analysis). Therefore, according to another feature of filter 100, high power transmitters can be coupled to filter 100 since the temperature rise due to power dissipation in the ceramic resonator 116 is minimized by the relatively low thermal resistance between ceramic resonator 116 and the top and bottom covers 112 and 128. For example, with twelve watts of RF energy dissipated in the filter 100, the temperature of ceramic resonator 116 will rise only 8° C. above ambient temperature and the frequency of filter 100 will drift approximately 8 kHz due to RF energy dissipation.

Referring back to FIG. 1, the housing for filter 100 includes top cover 112, housing 124 and bottom cover 128 which are preferably cast from aluminum alloy (e.g., #380 aluminum alloy). Top cover 112 includes a top hat 132 into which a threaded bushing 133 preferably comprised of brass is press fit. Top cover 112 also includes a recessed portion for receiving shield plate 142. Shield plate 142 includes three tabs 160, 161 and 162 for positioning disc 114. Likewise, bottom cover 128 includes a recessed area for receiving shield plate 148 and a portion of disc 120. The raised step 121 of disc 120 inserts into the hole in resonator 116. Tabs 160, 161 and 162 of shield plate 142, raised step 121 of disc 120 and recessed area of bottom cover 128 maintain resonator 116 in proper spatial relationship with discs 114 and 120. Top cover 112 is attached to housing 124 by means of four screws which insert into four holes, e.g. 107 and 108 at the periphery of cover 112 and housing 124. An O-ring 150 provides a moisture seal and, if impregnated or coated with conductive material, an electromagnetic seal between top cover 112 and housing 124. Bottom cover 128 is preferably cast with housing 124, but in other embodiments of filter 100, bottom cover 128 may be separate from housing 124 and attached thereto by means of screws.

In order to produce a high-Q filter, the housing of RF filters are typically made from or plated on their internal surfaces with a highly conductive material such as copper. For detailed filter design information, refer to the following two articles: "Design of Cylindrical Dielectric Resonators in Inhomogeneous Media," by Rene R. Bonetti and Ali E. Atia, IEEE Transactions on Microwave Theory and Techniques, Volume MTT-29, No. 4, pp. 323–326, April 1981; and "Microwave Bandpass Filters Containing High-Q Dielectric Resonators," by Seymour B. Cohn, IEEE Transactions on Microwave Theory and Techniques, Volume MTT-16, No. 4, pp. 218–227, April 1968. Although aluminum is not as good a conductor as copper, aluminum is castable and less expensive than copper. In the preferred embodiment of filter 100, housing parts 112, 124 and 128 are comprised of #380 aluminum alloy. However, due to lower conductivity of aluminum, the housing parts 112, 124 and 128 dissipate some of the external field of the resonator 116, thereby lowering the Q of filter 100 by as much as nine percent (9%).

According to another feature of filter 100, lowering of the Q of filter 100 due to the aluminum housing parts 112, 124 and 128 is substantially avoided by utilizing a highly conductive shield plate 142 between disc 114 and top cover 112 and another highly conductive shield plate 148 between disc 120 and bottom cover 128 A third highly conductive shield plate 140 is also disposed on the top surface of tuning core 118. Shield plates 140, 142 and 148 are preferably comprised of copper (silver or gold are also suitable) to provide the desired low-loss path for the external field at the top surface of tuning core 118, the top surface of disc 114, and the bottom surface of disc 120, respectively. In other embodiments, shield plates 140, 142 and 148 could be constructed of a non-conductor and plated with copper, silver or gold, all of which have a conductivity greater than $1.3\times10^7$ mho/m, the conductivity of #380 aluminum alloy. By utilizing copper shield plates 140, 142 and 148, housing parts 112, 124 and 128 may be made from aluminum or other low conductivity metallic materials which are much cheaper than copper or copper plated materials without degrading the Q of filter 100. Therefore, filter 100 is relatively inexpensive while at the same time having a relatively high-Q.

Copper shield plate 142 also includes three tabs 160, 161 and 162 for positioning disc 114, and further includes raised portions 144, 145, 146 and 147 for producing a spring force when cover 112 and housing 124 are assembled. Thus, housing parts 112, 124 and 128 totally enclose the sandwiched ceramic resonator 116 and compress raised portions 144, 145, 146 and 147 of plate 142 to produce a spring force for maintaining the spatial relationship between ceramic resonator 116 and alumina compensating discs 114 and 120. Moreover, raised portions 144, 145, 146 and 147 of copper shield plate 142 are made large enough to conduct heat from disc 114 to top cover 112 for minimizing temperature rise of resonator 116 due to power dissipation. In other embodiments, ceramic resonator 116 and alumina compensating discs 114 and 120 may be maintained in spatial relationship with one another by bonding them together with a suitable adhesive such as glass frit or bonding film.

The resonant frequency of ceramic resonator 116 may be adjusted by means of threaded tuning shaft 102 and dielectric tuning core 118 attached thereto. The resonant frequency of resonator 116 decreases as tuning core 118 is inserted into substantially concentric holes in shield plate 142, disc 114 and resonator 116. In the preferred embodiment, disc 120 does not include a hole for tuning core 118 since tuning core 118 need not be inserted into disc 120 in order to achieve the desired tuning range. In other embodiments, disc 120 may also have a hole concentric with the holes in disc 114 and resonator 116. Tuning core 118 is preferably comprised of a low-loss ceramic material, such as, for example, the same ceramic material used for resonator 116. Tuning core 118 not only changes the resonant frequency, but also eliminates some spurious resonant modes (by keeping the overall housing dimensions constant as the frequency of resonator 116 is tuned), minimizes resonator de-Q-ing (because it employs a low-loss ceramic material), and allows discs 114 and 120 to be in good thermal contact with resonator 116 over its entire top and bottom surfaces. Although resonator 116 is preferably tuned by means of tuning core 118, other suitable conventional tuning apparatus may also be utilized.

Tuning shaft 102 is threaded and mates with a correspondingly threaded brass bushing 133, which is press fit into top hat 132 of top cover 112. The position of the shaft 102 may be fixedly held by tightening nut 104 and washer 106. Tuning shaft 102, housing 124 and covers 112 and 128 are preferably comprised of aluminum. Since aluminum is non-ferrous, tuning shaft 102, housing 124 and covers 112 and 128 experience less Q degradation when subjected to external magnetic fields if comprised of aluminum rather than steel or other ferrous materials.

Tuning shaft 102, tuning core 118, bushing 133, compensating discs 114 and 116 and housing parts 112, 124 and 128 may also be comprised of pre-selected materials each having different coefficients of expansion for compensating for changes in the resonant frequency of resonator 116 with ambient temperature. For example, the movement of tuning core 118 over ambient temperatures may be partially compensated by bushing 133 and the height of top hat 132 of top cover 112. That is, the desired temperature compensation is achieved by the difference in the coefficient of expansion between, and the respective sizes of, bushing 133, tuning shaft 102, top hat 132 and tuning core 118. This arrangement can compensate for a worst case change of 1.1 ppm/°C. of the frequency temperature coefficient of filter 100.

The dimensions of the various elements of an embodiment filter 100 for operation at frequencies between 865–902 MHz are listed below in Table I. In this embodiment, the resonator 116 and tuning core 118 are comprised of the ceramic compound, discs 114 and 120 of alumina, bushing 133 of brass, tuning shaft 102 of aluminum and the housing parts 112, 124 and 128 of #380 aluminum alloy. The exact dimensions of the elements of an embodiment of filter 100 will vary depending on the desired frequency of operation and the materials chosen for each of the elements.

TABLE I

| Element | Filter Dimensions In Inches: Outer Diameter | Inner Diameter | Length |
|---|---|---|---|
| Resonator 116 | 2.68 | 1.26 | 0.77 |
| Disc 114 | 2.80 | 1.26 | 1.14 |
| Disc 120 | 2.80 | — | 1.13 |
| Core 118 | 1.20 | — | 1.37 |
| Shaft 102 | 0.38 | — | 2.30 |
| Housing 124 | 5.62 | 5.50 | 3.00 |
| Top Cover 112 | 5.62 | 1.50 | 0.90 |
| Bottom Cover 128 | 5.62 | — | — |

Referring next to FIG. 2, there is illustrated antenna combining apparatus for coupling RF transmitters 201–205 having different signal frequencies to a common antenna 231. Filters 211–215 are preferably filters 100 embodying the present invention. Combiner 221 is preferably the microstrip combiner 300 shown in FIG. 3. Combiner 221 may also be a suitable conventional antenna combiner such as that shown and described in the U.S. Pat. No. 4,375,622, which is incorporated herein by reference thereto. By utilizing the RF filter 100 for filters 211–215, the overall size and space requirements of the combining apparatus in FIG. 2 can be significantly reduced. Since space is at a premium in remotely located antenna sites, a substantial cost savings can be realized by utilizing the filter 100.

Figure 3:
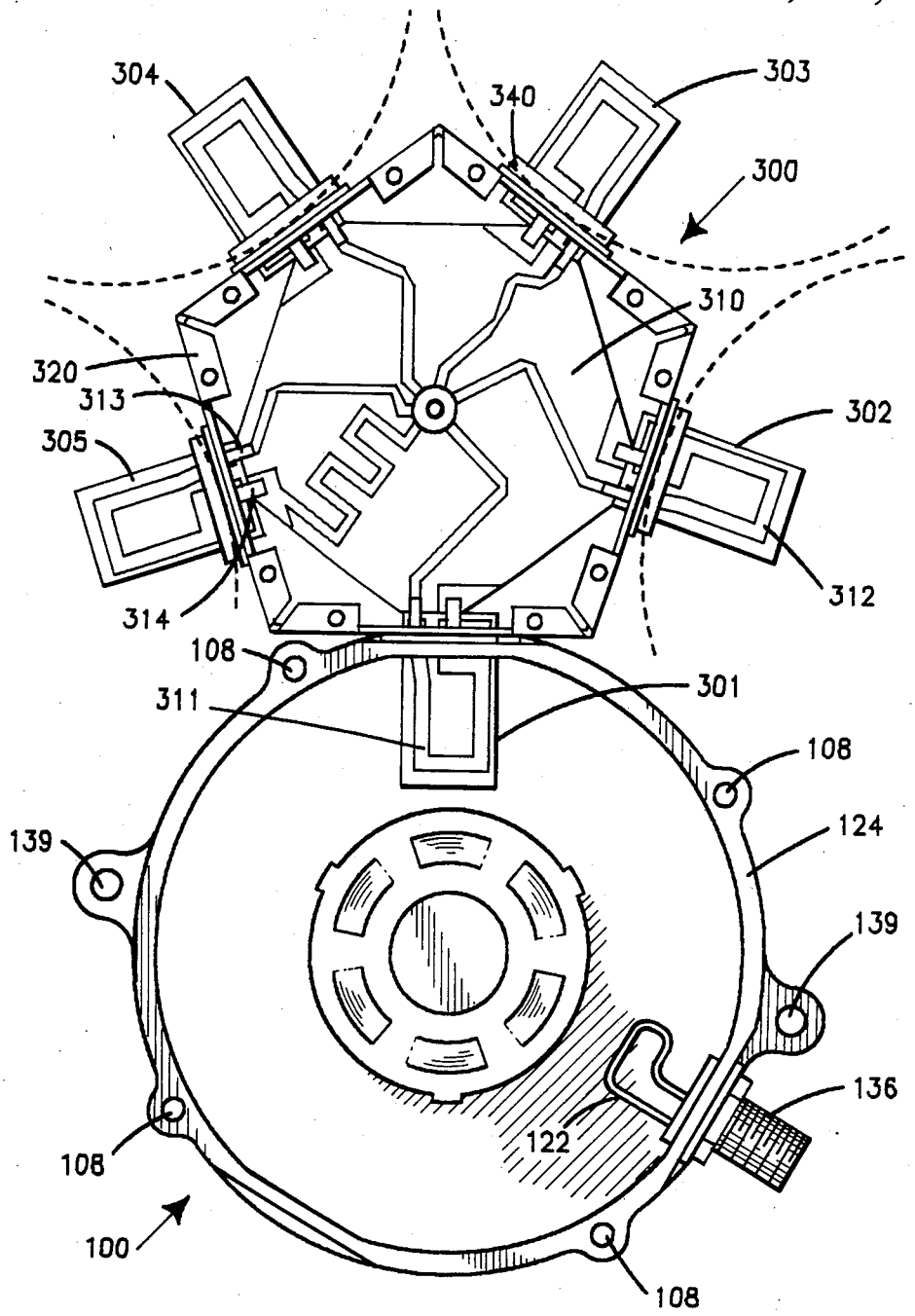
FIG. 3 is a top view of a microstrip combiner and the RF filter illustrated in FIG. 1.

Referring next to FIG. 3, there is illustrated a top view of filter 100 and microstrip combiner 300 embodying the present invention. The top cover 112 of filter 100 is removed to more clearly show coupling loops 122 and 311. Two screws insert into holes 139 for mounting each of the five filters 100 to a suitable mounting panel. Four screws insert into holes 108 for mounting top cover 112 to housing 124.

RF signals are coupled to filter 100 in FIG. 3 by means of coupling loop 122 of connector 136 and are coupled from filter 100 by coupling loop 311 on circuit board 301. In the preferred embodiment of filter 100, coupling loops 122 and 311 are located substantially in the same plane as the center of resonator 116 and are disposed at approximately 120° with respect to one another as shown in FIG. 3. Since the exact location of coupling loop 122 is not critical to operation of filter 100, coupling loop 122 may also be located on housing 124 at any suitable location in the plane of the center of resonator 116, as long as coupling loop 122 and coupling loop 311 are sufficiently separated to avoid undesirable direct coupling.

Figure 4:
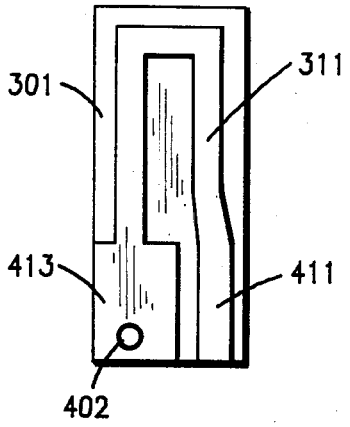
FIG. 4 is a top view of a coupling loop circuit board used in the microstrip combiner illustrated in FIG. 3.
Figure 5:
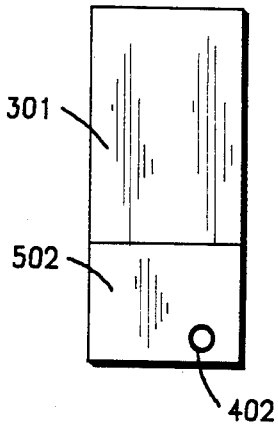
FIG. 5 is a bottom view of the circuit board illustrated in FIG. 4.

Combiner 300 in FIG. 3 includes substrate circuit board 310 (see also FIG. 6), metal housing 320 and five coupling circuit boards 301–305 (see also FIGS. 4 and 5). An output connector 902 (see FIG. 9) is soldered to the center of substrate circuit board 310 and extends out of the underside of metal housing 320. Board 301 is preferably comprised of a dielectric material suitable for microstrip transmission lines. In the preferred embodiment of combiner 300, substrate circuit board 310 is comprised of alumina. Coupling circuit boards 301–305 are attached to housing 320 with a screw. Strap 314 is soldered between coupling loop 312 and the ground on board 310, and strap 313 is soldered between coupling loop 312 and a corresponding microstrip line on board 310. Similar straps are used to couple boards 301, 303, 304 and 305 to board 310. Housing 320 is attached by two screws to platform 154 on each filter 100. Once attached to each of five filters 100, housing 320 is enclosed by attaching a metal top plate 330 with screws (see FIG. 8).

Each coupling circuit board 301–305 inserts into corresponding apertures 152 in the housing 124 of filter 100, and are each moisture sealed by a rubber boot, e.g. 340. A transmitter signal from a transmitter, e.g. 201 is applied to connector 136 and coupled to resonator 116 by coupling loop 122. The filtered transmitter signal is detected by coupling loop 311 on circuit board 301. Microstrip circuitry on board 310 combines the five transmitter signals and couples them to output connector 902 (see FIG. 9).

Referring next to FIGS. 4 and 5, there is illustrated in more detail coupling circuit board 301 and coupling loop 311. Coupling loop 311 is metallic plating, preferably copper plating, on the top surface of board 301, preferably random-fiber PTFE with a nominal dielectric constant of 2.1. Board 301 is attached to housing 320 of combiner 300 by a screw which inserts into hole 402. Board 301 contains a fifty-ohm microstrip transmission line 411, coupling loop 311 and ground pad 413. As shown in FIG. 5, only portion 502 of the bottom surface of board 301 is copper plated. Portion 502 is opposite to fifty-ohm microstrip transmission line 411 and ground pad 413. That is, there is no plating on the bottom surface of board 301 opposite to coupling loop 311.

Figure 6:
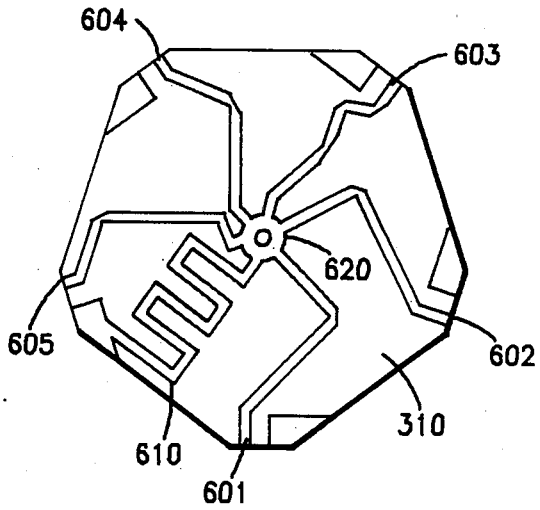
FIG. 6 is a top view of the microstrip circuit board used in the microstrip combiner illustrated in FIG. 3.

Referring next to FIG. 6, there is illustrated in more detail substrate circuit board 310. Board 310 is copper-plated on its bottom side and includes five fifty-ohm microstrip transmission lines 601–605 of equal length on its top side for coupling corresponding filtered transmitter signals to junction 620. Junction 620 has a hole in its center for accepting the center conductor of the output connector 902 (see FIG. 9). Board 310 also includes serpentine transmission line 610 for tuning junction 620.

Figure 7:
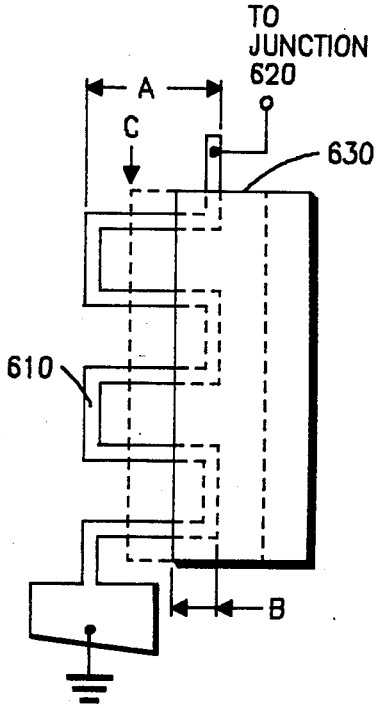
FIG. 7 illustrates the tuning circuitry used to tune the microstrip combiner illustrated in FIG. 3.

Referring next to FIG. 7, there is illustrated unique variable reactance tuning circuitry of the present invention including serpentine transmission line 610 and dielectric tuning plate 630 for tuning microstrip combiner 300 in FIG. 3. Line 610 is a short-circuited transmission line of length $3\lambda/4$, having infinite input reactance when half of its physical length L is covered by dielectric tuning plate 630. Line 610 may be configured in a serpentine pattern as illustrated or may simply be straight or any other suitable shape dictated by a proposed application thereof. Together line 610 and tuning plate 630 provide an impedance whose reactance may be varied from inductive to capacitive simply by moving plate 630 relative to line 610, e.g. from position B to position C.

The unique variable reactance tuning circuitry in FIG. 7 presents an input impedance of $Z_I = jX$, where the value of the input reactance X is varied by moving plate 630 relative to line 610. According to the present invention, the amount of variation of the input reactance X is determined by the length of line 610 and the dielectric constant of tuning plate 630. Increasing either the length of line 610 or the dielectric constant of plate 630 increases the reactance tuning range and vice versa. The center of the reactance tuning range is determined by the impedance terminating line 610 and the length of line 610. In general, the input impedance $Z_I$ may be calculated by the equation:

$$Z_I = Z_O\left[\frac{Z_T/Z_O + j\tan\beta L}{1 + (Z_T/Z_O)j\tan\beta L}\right], \text{ where:} \quad (1)$$

-continued $$\beta L = 2\pi(f/c)\,(L_1\sqrt{\epsilon_{r1}} + L_2\sqrt{\epsilon_{r2}});$$

f is frequency;

c is the speed of light;

$Z_o$ is the characteristic impedance of line 630;

$Z_T$ is the impedance terminating line 630;

Line 630 has a physical length of $L = L_1 + L_2$; and $\epsilon_{r1}$ and $\epsilon_{r2}$ are the effective dielectric constants of the covered and uncovered portions $L_1$ and $L_2$, respectively.

In the preferred embodiment of the unique variable reactance tuning circuitry in FIG. 7, tuning transmission line 610 is terminated by a short circuit, i.e. $Z_T = 0$. When terminated by a short circuit, the above equation for the input impedance $Z_I$ of line 610 reduces to:

$$Z_I = jZ_o \tan(\beta L). \quad (2)$$

According to the present invention, the center of the reactance tuning range (i.e. when plate 630 covers one-half of line 610 or $L_1 = L_2 = L/2$) can be chosen as desired for each specific application of the unique variable reactance tuning circuitry in FIG. 7. For the preferred embodiment of combiner 300, the center of the reactance range was chosen to be infinite reactance so that the input reactance X of the input impedance $Z_I$ may be shifted between capacitive and inductive reactances. Since infinite reactance has no effect on operation of combiner 300, combiner 300 is tuned by shifting the input reactance X from infinite to increasing amounts of capacitive or inductive reactance to achieve the desired combiner characteristics. For any specific terminating impedance $Z_T$, the input impedance $Z_I$ of the unique variable reactance tuning circuitry in FIG. 7 is shifted over a range given by equation (1) above and centered about the predetermined input impedance produced when plate 630 covers one-half of tuning transmission line 610 (i.e. $L_1 = L_2 = L/2$).

When used in conjunction with combiner 300, the unique tuning circuitry 610 and 630 in FIG. 7 provides variable compensation for the reactance associated with the microstrip discontinuity at the junction 620 of five microstrip transmission lines 601–605. As a result, combiner 300 exhibits greater transmission efficiency over a wider bandwidth than would be obtainable without the unique tuning circuitry of the present invention. Moreover, the unique tuning circuitry of the present invention can be advantageously utilized in any suitable application where variable inductive and/or capacitive tuning is desired.

Figure 8:
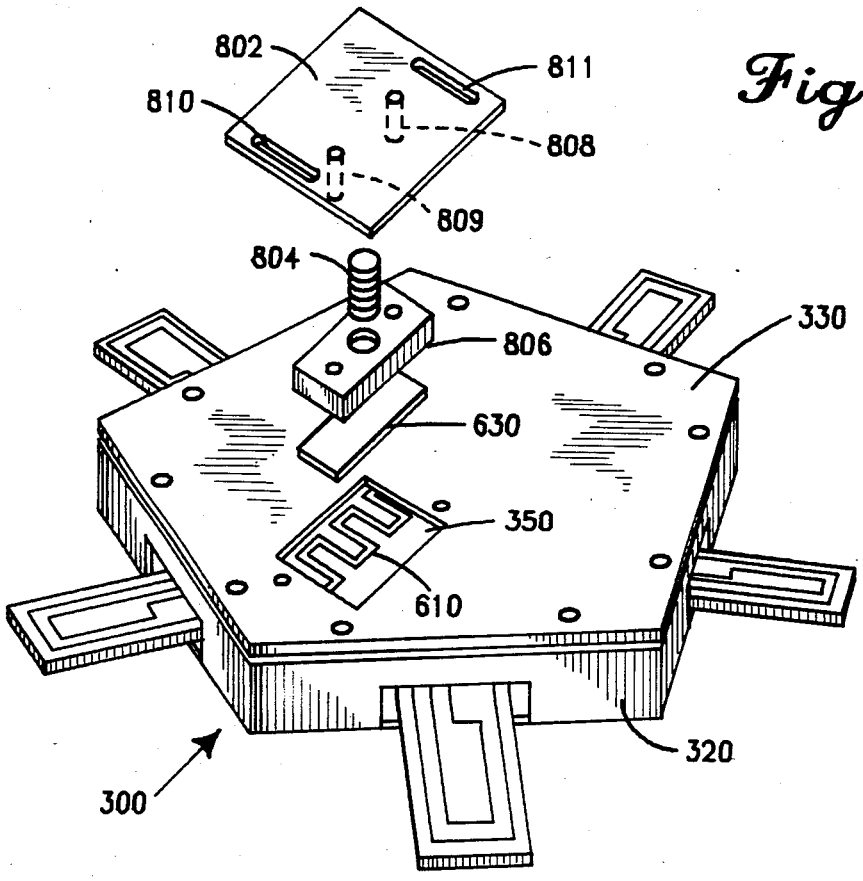
FIG. 8 is an exploded view of the tuning circuitry and apparatus used to tune the microstrip combiner illustrated in FIG. 3.

Referring to FIG. 8, there is illustrated an exploded view of the unique stripline tuning circuitry and apparatus of the present invention used to tune the microstrip combiner 300 illustrated in FIG. 3. Top plate 330 is secured to housing 320 by means of screws. Plate 330 also includes a hole 350 for access to serpentine transmission line 610. Dielectric tuning plate 630 is bonded to block 806 by a suitable adhesive. Block 806 includes three holes, one for accepting spring 804 and the other two for posts 808 and 809. Cover plate 802 includes posts 808 and 809 and slotted holes 810 and 811. Screws insert into holes 810 and 811 for attaching cover plate 802 to top plate 330 of combiner 300. Posts 808 and 809 of plate 802 position block 806 and dielectric tuning plate 630 over serpentine transmission line 610. Spring 804 forces dielectric tuning plate 630 against serpentine transmission line 610. When tuning combiner 300, the screws retaining plate 802 are loosened and plate 802 is slid back and forth in the direction of slotted holes 810 and 811 to tune combiner 300. When the desired tuning is achieved, the screws retaining plate 802 are tightened. The foregoing unique tuning apparatus and process of the present invention allow combiner 300 to be quickly and accurately tuned.

Figure 9:
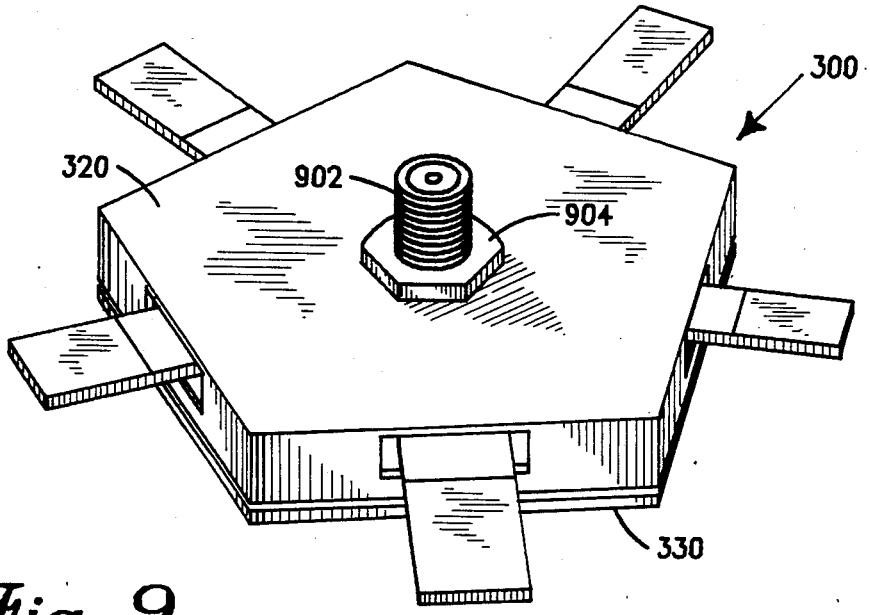
FIG. 9 is a bottom view of the microstrip combiner illustrated in FIG. 3.

Referring to FIG. 9, there is illustrated a bottom view of the microstrip combiner 300 illustrated in FIG. 3. Output connector 902 extends from the bottom of housing 320 and provides the combined output signal of combiner 300. Connector 902 is secured to housing 320 by means of nut 904.

In summary, novel RF signal combining apparatus has been described that includes a microstrip combiner coupled to ceramic filters by unique coupling loops and tuned by unique variable reactance tuning circuitry. The novel tuning circuitry includes a tuning transmission line and a dielectric tuning plate, the tuning range of which is determined by the length of the tuning transmission line and the dielectric constant of the tuning plate. If the tuning transmission line is terminated by a short circuit, the input reactance of the novel tuning circuitry may be varied between inductive and capacitive reactances simply by adjusting the amount by which the dielectric tuning plate covers the tuning transmission line. The unique tuning circuitry of the present invention can be advantageously utilized in any suitable application where a variable input reactance is required.

We claim:

1. Tuning circuitry having a variable input impedance, comprising:

substrate means having a first side and a second side, said second side having metallic plating thereon;

tuning transmission line means having an input, having a predetermined length, disposed on the first side of said substrate means, and being terminated by a predetermined terminating impedance;

dielectric plate means having a predetermined dielectric constant for covering said tuning transmission line means, the input impedance of said tuning circuitry having a predetermined input impedance when said dielectric plate means covers one-half of said tuning transmission line means;

means for adjusting the amount by which said dielectric plate means covers said tuning transmission line means to vary the input impedance of said tuning circuitry over a range centered about the predetermined input impedance;

said adjusting means further including housing means for enclosing said tuning circuitry, and cover plate means coupled to said housing means for positioning said dielectric plate means and forcing said dielectric plate means against said tuning transmission line means; and said cover plate means further including two posts extending therefrom, spring means, and block means having two holes for accepting said posts and another hole for accepting said spring means, said dielectric plate means being fixedly attached to said block means.

2. The tuning circuitry according to claim 1, wherein said tuning transmission line means comprises a transmission line having a serpentine shape and being terminated by a short circuit.

3. Apparatus for combining at least two radio frequency (RF) signals having different predetermined frequencies and being generated by separate signal sources to produce a composite output signal, said RF signal combining apparatus comprising:

substrate means having a first side and a second side, said second side having metallic plating thereon;

junction means disposed on the first side of said substrate means and producing the composite output signal;

a plurality of transmission line means each being coupled to said junction means and having an input coupled to a corresponding RF signal; and tuning circuitry having a variable input impedance, comprising:

tuning transmission line means having an input coupled to said junction means, having a predetermined length, disposed on the first side of said substrate means and being terminated by a predetermined terminating impedance;

dielectric plate means having a predetermined dielectric constant for covering said tuning transmission line means, the input impedance of said tuning circuitry having a predetermined input impedance when said dielectric plate means covers one-half of said tuning transmission line means; and means for adjusting the amount by which said dielectric plate means covers said tuning transmission line means to vary the input impedance of said tuning circuitry over a range centered about the predetermined input impedance.

4. The combining apparatus according to claim 3, wherein said tuning transmission line means comprises a transmission line having a serpentine shape and being terminated by a short circuit.

5. The combining apparatus according to claim 3, wherein said adjusting means comprises: housing means for enclosing said combining apparatus; and cover plate means coupled to said housing means for positioning said dielectric plate means and forcing said dielectric plate means against said tuning transmission line means.

6. The combining apparatus according to claim 5, wherein said cover plate means further includes two posts extending therefrom, spring means and block means having two holes for accepting said posts and another hole for accepting said spring means, said dielectric tuning plate being fixedly attached to said block means.

7. Radio frequency (RF) signal combining apparatus, comprising:

antenna means;

a plurality of RF signal transmitters each having a different predetermined frequency and producing an RF signal;

a plurality of filtering means each coupled to a different one of said RF signals and producing an output signal; and combining means comprising:

substrate means having a first side and a second side, said second side having metallic plating thereon;

junction means disposed on the first side of said substrate means and being coupled to said antenna means;

a plurality of transmission line means each having an output coupled to said junction means and having an input coupled to a corresponding filtering means output signal; and tuning transmission line means having an input coupled to said junction means, having a variable input impedance, having a predetermined length, being disposed on the first side of said substrate means, and being terminated by a predetermined terminating impedance;

dielectric plate means having a predetermined dielectric constant for covering said tuning transmission line means, the input impedance of said tuning transmission line means having a predetermined input impedance when said dielectric plate means covers one-half of said tuning transmission line means; and means for adjusting the amount by which said dielectric plate means covers said tuning transmission line means to vary the input impedance of said tuning transmission line means over a range centered about the predetermined input impedance.

8. The RF signal combining apparatus according to claim 7, wherein said tuning transmission line means comprises a transmission line having a serpentine shape and being terminated by a short circuit.,

9. The RF signal combining apparatus according to claim 7, further including a plurality of coupling circuit boards each having a coupling loop thereon, each of said coupling loops coupled to a corresponding one of said transmission line means and terminated by a short circuit for receiving the output signal form a corresponding one of said filtering means.

10. The RF signal combining apparatus according to claim 7, wherein said adjusting means comprises: housing means for enclosing said combining means; and cover plate means coupled to said housing means for positioning said dielectric plate means and forcing said dielectric plate means against said tuning transmission line means.

11. The RF signal combining apparatus according to claim 10, wherein said cover plate means further includes two posts extending therefrom, spring means and block means having two holes for accepting said posts and another hole for accepting said spring means, said dielectric tuning plate being fixedly attached to said block means.

12. The RF signal combining apparatus according to claim 7, wherein said filtering means each comprises:

resonating means having top and bottom surfaces and being comprised of a ceramic material having a predetermined thermal conductivity;

first and second compensating means each having top and bottom surfaces and being disposed above and below the resonating means, respectively, the bottom surface of the first compensating means and the top surface of the second compensating means being thermally coupled to the top and bottom surfaces of the resonating means, respectively, and the first and second compensating means being comprised of a dielectric material having a thermal conductivity greater than the the thermal conductivity of air;

first and second shield means being comprised of a metallic material and being thermally coupled to and disposed above and below the the first and second compensating means, respectively, for producing a low-loss electromagnetic path above and below said resonating means;

housing means being comprised of a metallic material having an electrical conductivity less than that of the metallic material of said first and second shield means and further including top, bottom and side surfaces;

input coupling means and output coupling means disposed on the side surface of said housing means opposite to said resonating means and at a preselected distance form one another, said input coupling means coupled to a corresponding one of said RF signals, and said output coupling means coupled to a corresponding one of the transmission line means of said combining means; and said housing means substantially enclosing and retaining the resonating means between the first and second compensating means and the first and second shield means, the top and bottom surfaces of the housing means being thermally coupled to the first and second shield means, respectively, whereby a low thermal resistance path is produced between the resonating means, first and second compensating means, first and second shield means and the housing means for conducting away form said resonating means heat dissipated therein thereby minimizing the temperature rise of said resonating means due to power dissipation.

13. The RF signal combining apparatus according to claim 12, wherein said output coupling means each comprises a coupling circuit board having a coupling loop thereon coupled to a corresponding one of said transmission line means and terminated by a short circuit for receiving the output signal form a corresponding one of said filtering means.

14. The RF signal combining apparatus according to claim 12, wherein said adjusting means comprises: housing means for enclosing said combining means; and cover plate means coupled to said housing means for positioning said dielectric plate means and forcing said dielectric plate means against said tuning transmission line means.

15. The RF signal combining apparatus according to claim 14, wherein said cover plate means further includes two posts extending therefrom, spring means and block means having two holes for accepting said posts and another hole for accepting said spring means, said dielectric tuning plate being fixedly attached to said block means.

16. Tuning circuitry having a variable input reactance, comprising:

substrate means having a first side and a second side, said second side having metallic plating thereon;

tuning transmission line means having an input and a predetermined length, disposed on the first side of said substrate means, and being terminated by a short circuit;

dielectric plate means having a predetermined dielectric constant for covering said tuning transmission line means, the input reactance of said tuning circuitry having a substantially infinite magnitude when said dielectric plate means covers one-half of said tuning transmission line means;

means for adjusting the amount by which said dielectric plate means covers said tuning transmission line means to vary the input reactance of said tuning circuitry between a predetermined inductive reactance and a predetermined capacitive reactance;

said adjusting means further including housing means for enclosing said tuning circuitry, and cover plate means coupled to said housing means for positioning said dielectric plate means and forcing said dielectric plate means against said tuning transmission line means; and said cover plate means further including two posts extending therefrom, spring means, and block means having two holes for accepting said posts and another hole for accepting said spring means, said dielectric plate means being fixedly attached to said block means.

17. The tuning circuitry according to claim 16, wherein said tuning transmission line means comprises a transmission line having a serpentine shape.

18. Tuning circuitry having a variable input reactance, comprising:

substrate means having a first side and a second side, said second side having metallic plating thereon;

tuning transmission line means having an input and a predetermined length, disposed on the first side of said substrate means, and being terminated by a predetermined terminating impedance having no resistive component;

dielectric plate means having a predetermined dielectric constant for covering said tuning transmission line means, the input reactance of said tuning circuitry having a substantially infinite magnitude when said dielectric plate means covers one-half of said tuning transmission line means;

means for adjusting the amount by which said dielectric plate means covers said tuning transmission line means to vary the input reactance of said tuning circuitry between a predetermined inductive reactance and a predetermined capacitive reactance;

said adjusting means further including housing means for enclosing said tuning circuitry, and cover plate means coupled to said housing means for positioning said dielectric plate means and forcing said dielectric plate means against said tuning transmission line means; and said cover plate means further including two posts extending therefrom, spring means, and block means having two holes for accepting said posts and another hole for accepting said spring means, said dielectric plate means being fixedly attached to said block means.

19. The tuning circuitry according to claim 18, wherein said tuning transmission line means comprises a transmission line having a serpentine shape and being terminated by a short circuit.

20. Apparatus for combining at least two radio frequency (RF) signals having different predetermined frequencies and being generated by separate signal sources to produce a composite output signal, said RF signal combining apparatus comprising:

substrate means having a first side and a second side, said second side having metallic plating thereon;

junction means disposed on the first side of said substrate means and producing the composite output signal;

a plurality of transmission line means each being coupled to said junction means and having an input coupled to a corresponding RF signal; and tuning circuitry having a variable input reactance, comprising:

tuning transmission line means having an input coupled to said junction means, having a predetermined length, disposed on the first side of said substrate means and being terminated by a short circuit;

dielectric plate means having a predetermined dielectric constant for covering said tuning transmission line means, the input reactance of said tuning circuitry having a substantially infinite magnitude when said dielectric plate means covers one-half of said tuning transmission line means; and means for adjusting the amount by which said dielectric plate means covers said tuning transmission line means to vary the input reactance of said tuning circuitry between a predetermined inductive reactance and a predetermined capacitive reactance.

* * * * *